US011646551B2

(12) United States Patent
Cress

(10) Patent No.: US 11,646,551 B2
(45) Date of Patent: May 9, 2023

(54) SPARK PLUG

(71) Applicant: Caterpillar Inc., Peoria, IL (US)

(72) Inventor: James Jay Cress, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/304,637

(22) Filed: Jun. 23, 2021

(65) Prior Publication Data

US 2022/0416515 A1 Dec. 29, 2022

(51) Int. Cl.

| | |
|---|---|
| ***H01T 13/54*** | (2006.01) |
| ***H01T 13/39*** | (2006.01) |
| ***H01T 13/40*** | (2006.01) |
| ***H01T 13/46*** | (2006.01) |

(52) U.S. Cl.

CPC ..... *H01T 13/39* (2013.01); *H01T 13/40* (2013.01); *H01T 13/467* (2013.01); *H01T 13/54* (2013.01)

(58) Field of Classification Search

CPC ..... H01T 13/467; H01T 13/54
USPC ..... 313/141
See application file for complete search history.

(56) References Cited

U.S. PATENT DOCUMENTS

| | | | | |
|---|---|---|---|---|
| 5,554,908 | A * | 9/1996 | Kuhnert | H01T 13/54 313/142 |
| 7,922,551 | B2 | 4/2011 | Tozzi | |
| 8,857,396 | B2 | 10/2014 | Giffels et al. | |
| 9,093,823 | B2 | 7/2015 | Sakakura et al. | |
| 9,166,378 | B2 | 10/2015 | Alfonso et al. | |
| 9,859,688 | B1 | 1/2018 | Gerstner | |
| 9,929,539 | B2 | 3/2018 | Maul et al. | |
| 9,982,588 | B2 | 5/2018 | Schäfer | |
| 10,145,292 | B1 * | 12/2018 | Cress | H01T 13/54 |
| 2016/0254650 | A1 * | 9/2016 | Maul | H01T 13/54 123/169 EL |

(Continued)

FOREIGN PATENT DOCUMENTS

| | | | |
|---|---|---|---|
| DE | 102020205320 | A1 * | 10/2021 |
| EP | 0675272 | B1 | 8/1997 |

(Continued)

OTHER PUBLICATIONS

Written Opinion and International Search Report for Int'l. Patent Appln. No PCT/US2022/032435, dated Sep. 16, 2022 (17 pgs).

*Primary Examiner* — Christopher M Raabe
(74) *Attorney, Agent, or Firm* — Brannon Sowers & Cracraft PC

(57) ABSTRACT

A spark plug includes a central electrode member and an outer electrode member. The central electrode member includes a central base and a plurality of electrode prongs extending in an axial direction from the central base. The outer electrode member surrounds the central electrode member. The outer electrode member includes a wall that is radially spaced from the plurality of electrode prongs to allow a series of electric arcs to form between the wall and the plurality of electrode prongs. The outer electrode member and the central electrode member are sized and positioned relative to one another such that a first rate of wear of the outer electrode member, along a longitudinal axis of the spark plug, is substantially equal to a second rate of wear of the central electrode member along the longitudinal axis.

14 Claims, 4 Drawing Sheets

(56) References Cited

U.S. PATENT DOCUMENTS

| | | | | |
|---|---|---|---|---|
| 2017/0145898 | A1* | 5/2017 | Schäfer | F02P 13/00 |
| 2019/0376441 | A1* | 12/2019 | Brubaker | F02P 13/00 |

FOREIGN PATENT DOCUMENTS

| | | | |
|---|---|---|---|
| EP | 2413442 | B1 | 10/2016 |
| WO | 2014043657 | A2 | 3/2014 |

* cited by examiner

SPARK PLUG

TECHNICAL FIELD

The present disclosure relates generally to a spark plug and, for example, to a spark plug for a spark-ignition (SI) engine.

BACKGROUND

An internal combustion engine powers a machine by converting chemical energy stored in fuel (e.g., gasoline, compressed natural gas (CNG), methanol, ethanol, bioethanol, or another type of fuel) into mechanical work. In such an engine, air is mixed with the fuel to form an air-fuel mixture. Some engines utilize a spark plug, which typically includes a central electrode and one or more outer electrodes. The spark plug may transmit an electric current along the central electrode into a chamber that is fluidly connected to or inside of a cylinder. A piston is movably mounted within the cylinder to travel in a cycle between a top dead center (TDC) position and a bottom dead center (BDC) position. In some embodiments, as the piston reaches the TDC position, a spark resulting from the electric current jumps a gap between the central electrode and the one or more outer electrodes, causing the air-fuel mixture to combust. A force of the combustion drives the piston down towards the BDC position, and the cycle repeats. Because the piston is connected to a drivetrain of the machine, continued movement of the piston propels and/or powers the machine.

While gaseous fuel (e.g., CNG, methanol, ethanol, bioethanol, and/or the like) is known to provide a relatively low power density, such fuel is also known to emit relatively low emissions. Thus, manufacturers have sought to produce engines that efficiently utilize such fuel. For example, to compensate for the relatively low power density provided by natural gas, manufacturers have developed CNG engines that operate under high compression ratios. Because of the high compression ratios, however, the combustion of the air-fuel mixture exposes certain engine components, such as a spark plug, to high temperatures and/or significant stress. As a result, the spark plug may be susceptible to premature wear, which may lead to increased costs associated with repair, replacement, and/or machine downtime. Furthermore, in some cases, the electrodes may wear unevenly, leading to a widening of a spark gap between the electrodes which prevents the electric current from bridging the spark gap. In such a case, in addition to the above-described costs, valuable material may also be wasted.

U.S. Pat. No. 10,145,292 discloses a spark plug including a pre-chamber for an engine. The spark plug includes a first cylindrical structure having a wall defining a bore. An electrode is positioned inside the bore such that the electrode is spaced apart from the wall to define at least one electrode spark gap. The spark plug further includes a second cylindrical structure configured to receive the first cylindrical structure. The second cylindrical structure has one or more access apertures configured to facilitate access to the wall of the first cylindrical structure.

The spark plug of the present disclosure solves one or more of the problems set forth above and/or other problems in the art.

SUMMARY

In some implementations, a spark plug includes a central electrode member that includes a base and a plurality of electrode prongs extending from the base, wherein the base is substantially centered on a longitudinal axis that extends through a geometric center of a first reference circle and a second reference circle, wherein the first reference circle has a first diameter, and the second reference circle has a second diameter that is greater than the first diameter by a gap length, an electrode prong, of the plurality of electrode prongs, includes an axial portion and a radial portion, wherein the axial portion includes an outer surface that partially defines the first reference circle, wherein the axial portion extends in an axial direction that is substantially parallel to the longitudinal axis, and axial portion has a width along a circumferential direction of the first reference circle and a thickness along a radial direction that is perpendicular to the axial direction, and the radial portion connects the axial portion to the base; and an outer electrode member that includes an interior surface that defines the second reference circle, and wherein $$P = \frac{w^2\sqrt{l}}{t^{2.5}}$$

where P is a parameter having a value in a range of approximately 1.5 to approximately 7.5, w is the width in millimeters, l is the gap length in millimeters, and t is the thickness in millimeters.

In some implementations, a spark plug includes a central electrode member that includes: a central base, and six electrode prongs extending radially and axially from the central base; and an outer electrode member that is concentric with and surrounds the central electrode member, wherein the outer electrode member includes a wall that is radially spaced from the six electrode prongs to allow a series of electric arcs to form between the wall and the six electrode prongs; wherein the outer electrode member and the central electrode member are sized and positioned relative to one another such that a first rate of wear of the outer electrode member, along a longitudinal axis of the spark plug, is substantially equal to a second rate of wear of the central electrode member along the longitudinal axis.

In some implementations, a method includes activating a power system that includes a spark plug attached to a cylinder, the spark plug including: a central electrode member extending an initial length along a longitudinal axis, and an outer electrode member that is concentric with and surrounds the central electrode member, wherein the outer electrode member includes a wall that is radially spaced from the central electrode member to define a gap between the wall and the central electrode member; transmitting a pulse of electric current along the central electrode member to generate a spark in the gap between the central electrode member and the outer electrode member, wherein the spark causes an air-fuel mixture to combust within the cylinder, the central electrode member to shorten from the initial length along the longitudinal axis, and a concavity to develop in the wall of the outer electrode member; and repeating the transmitting until the central electrode member has shortened from the initial length by at least 1.5 millimeters to a reduced length.

DETAILED DESCRIPTION

This disclosure relates to a spark plug, which is applicable to spark-ignition (SI) engines (e.g., a compressed natural gas (CNG)-powered engine, a methanol-powered engine, an ethanol-powered engine, a bioethanol-powered engine, a gasoline-powered engine, or another type of SI engine) and/or systems including SI engines. Such engines and/or engine systems may be implemented in a machine, such as a generator, a movable machine (e.g., a motor vehicle, a railed vehicle, a watercraft, an aircraft), or another type of machine.

To simplify the explanation below, the same reference numbers may be used to denote like features. The drawings may not be to scale.

Figure 1:
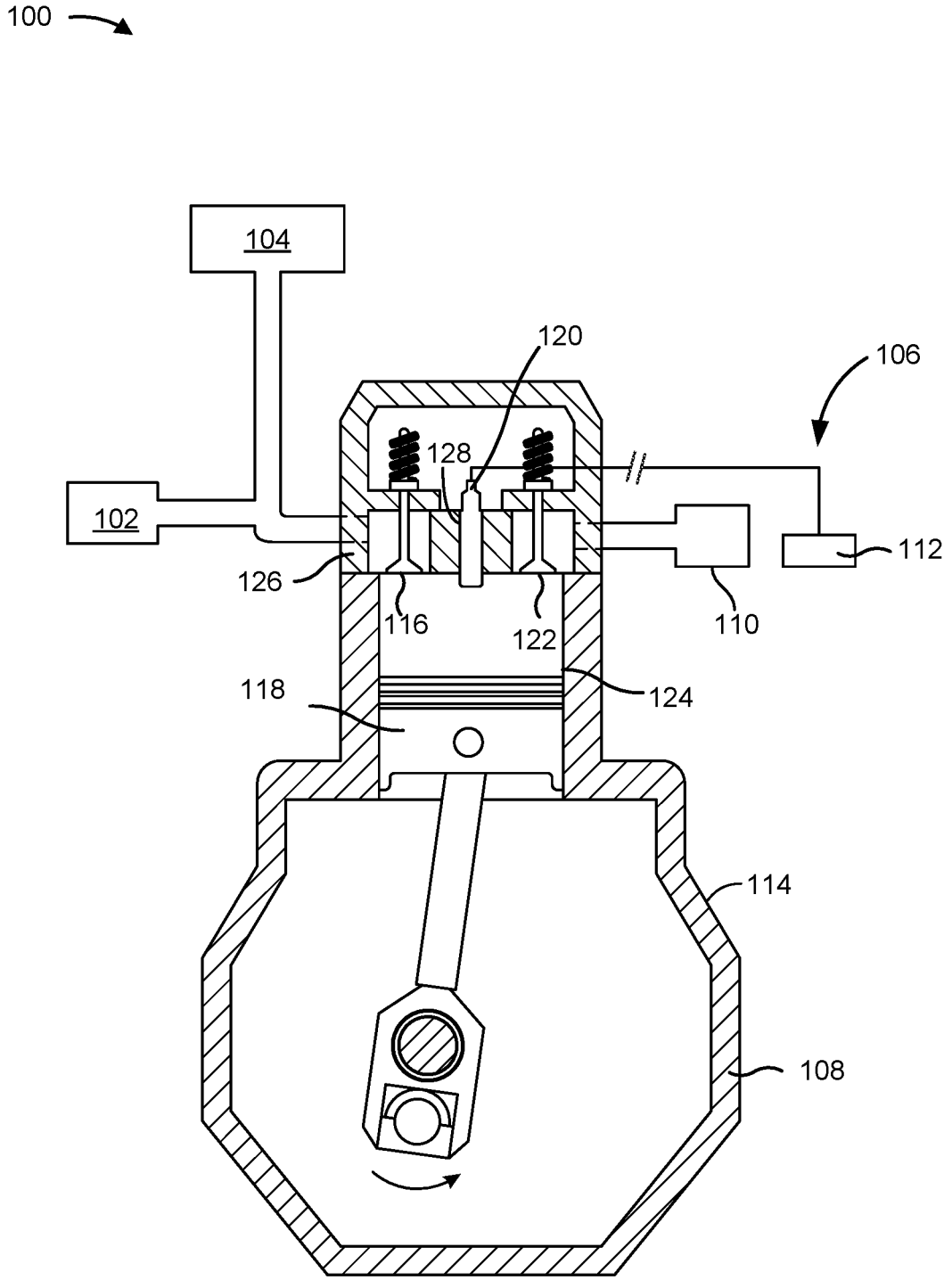
FIG. 1 is a diagram of an example power system.
Figure 2:
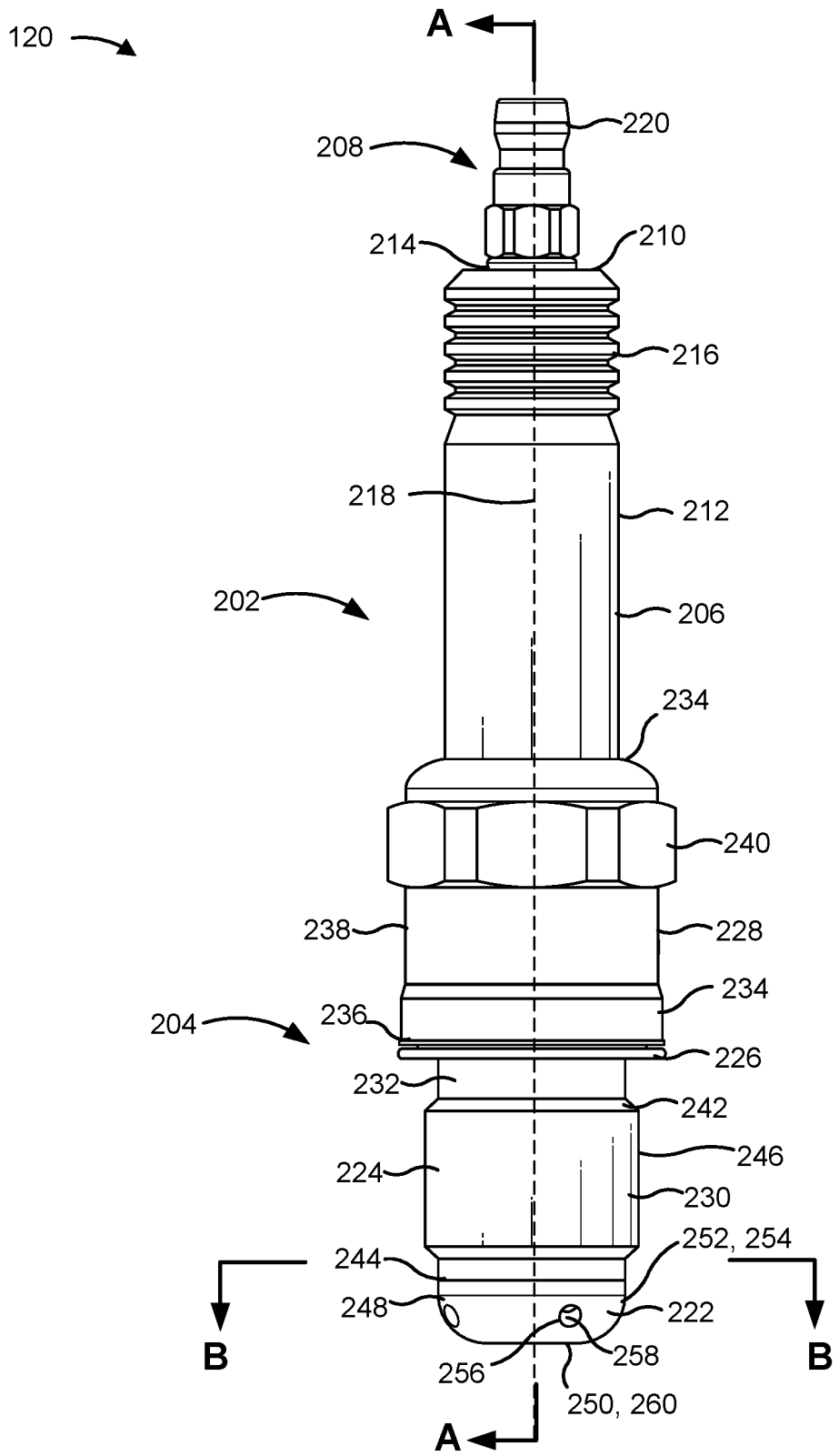
FIG. 2 is a side view of an example spark plug of the engine system.

FIG. 1 depicts a power system 100. The power system 100 includes an air inlet 102, a fuel tank 104, an ignition system 106, an engine 108, and an exhaust system 110. The air inlet 102 is a structure that is configured to receive and route air toward the engine 108. The fuel tank 104 is a structure that is configured to receive and distribute fuel (e.g., CNG, methanol, ethanol, bioethanol, gasoline, or another type of fuel) toward the engine 108 to mix with the air to form an air-fuel mixture. The ignition system 106 is a system that is configured to initiate a combustion of the air-fuel mixture in the engine 108. The ignition system 106 includes an electrical energy source 112, such as an ignition coil, that is electrically coupled to the engine 108. In some implementations, the ignition system 106 may further include one or more other electrical devices that are configured to control and/or communicate with the engine 108, such as an electronic control unit.

The engine 108 is a device that is configured to convert chemical energy stored in the fuel into mechanical work (e.g., by driving a crankshaft). The engine 108 includes an engine block 114, at least one inlet valve 116, a piston 118, a spark plug 120, and at least one outlet valve 122. The engine block 114, which includes at least one cylinder 124 and a cylinder head 126, houses the inlet valve 116, the piston 118, the spark plug 120, and the at least one outlet valve 122. The at least one inlet valve 116 is a mechanism that is configured to selectively permit the air-fuel mixture to enter the cylinder 124, which drives the piston 118 downward toward a bottom dead center (BDC) position. The piston 118 is a device that is movable within the cylinder 124 in a continuous cycle between the BDC position and a top dead center (TDC) position to propel and/or power a machine. During such movement, the piston 118 compresses the air-fuel mixture. The spark plug 120, which is mounted to a bore 128 within the cylinder head 126 above the cylinder 124, is a device that is configured to transmit an electric current from the electrical energy source 112 to cause the compressed air-fuel mixture to combust. A force of the combustion drives the piston 118 back down toward the BDC position. The at least one outlet valve 122 is a mechanism that is configured to selectively permit exhaust gas, resulting from combustion, to be expelled from the cylinder 124 as the piston 118 moves back to the TDC position.

The exhaust system 110 is a system, positioned downstream of the engine 108, that is configured to reduce or remove emission compounds (e.g., nitrous oxides (NOx), particulate matter, and/or hydrocarbons) from the exhaust gas to satisfy emission standards. For example, the exhaust system 110 may include a diesel particulate filter (DPF) (e.g., to treat the particulate matter), a selective catalytic reduction (SCR) module (e.g., to treat the NOx), and/or a diesel oxidation catalyst (DOC) (e.g., to treat the hydrocarbons).

As indicated above, FIG. 1 is provided as an example. Other examples may differ from what is described with regard to FIG. 1. For example, the number and arrangement of components (e.g., the air inlet 102, the fuel tank 104, the ignition system 106, the engine 108, and/or the exhaust system 110) may differ from that shown in FIG. 1. Thus, there may be additional components, fewer components, different components, differently shaped components, differently sized components, and/or differently arranged components than those shown in FIG. 1.

Figure 3:
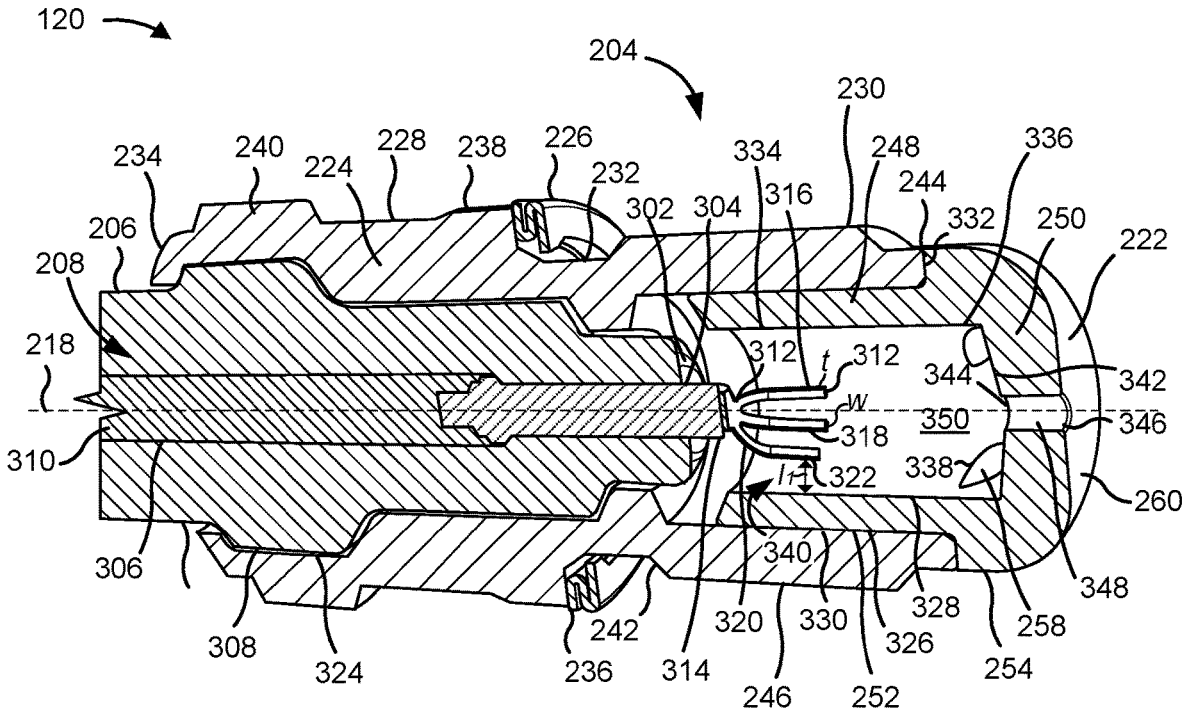
FIG. 3 is a cross-sectional view of the spark plug in an initial state, taken along lines A-A of FIG. 2.
Figure 4:
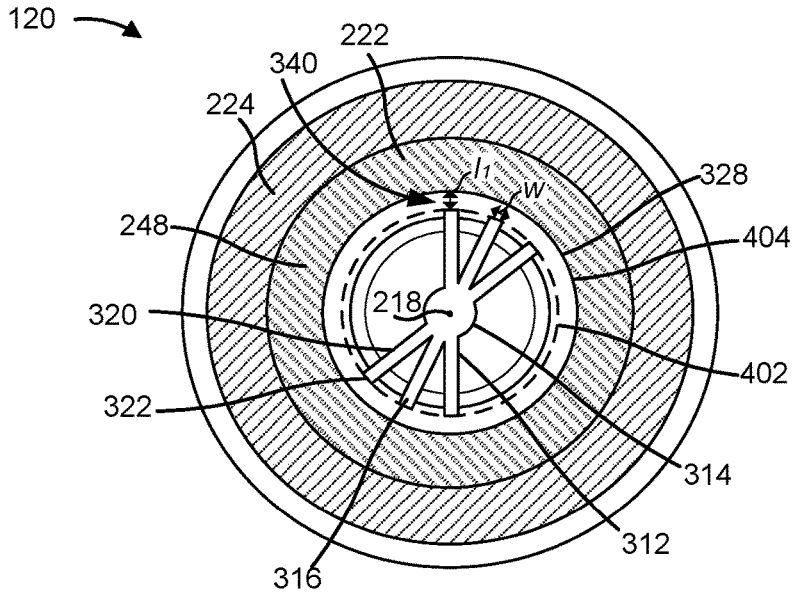
FIG. 4 is a cross-sectional view of the spark plug in the initial state, taken along lines B-B of FIG. 2.
Figure 5:
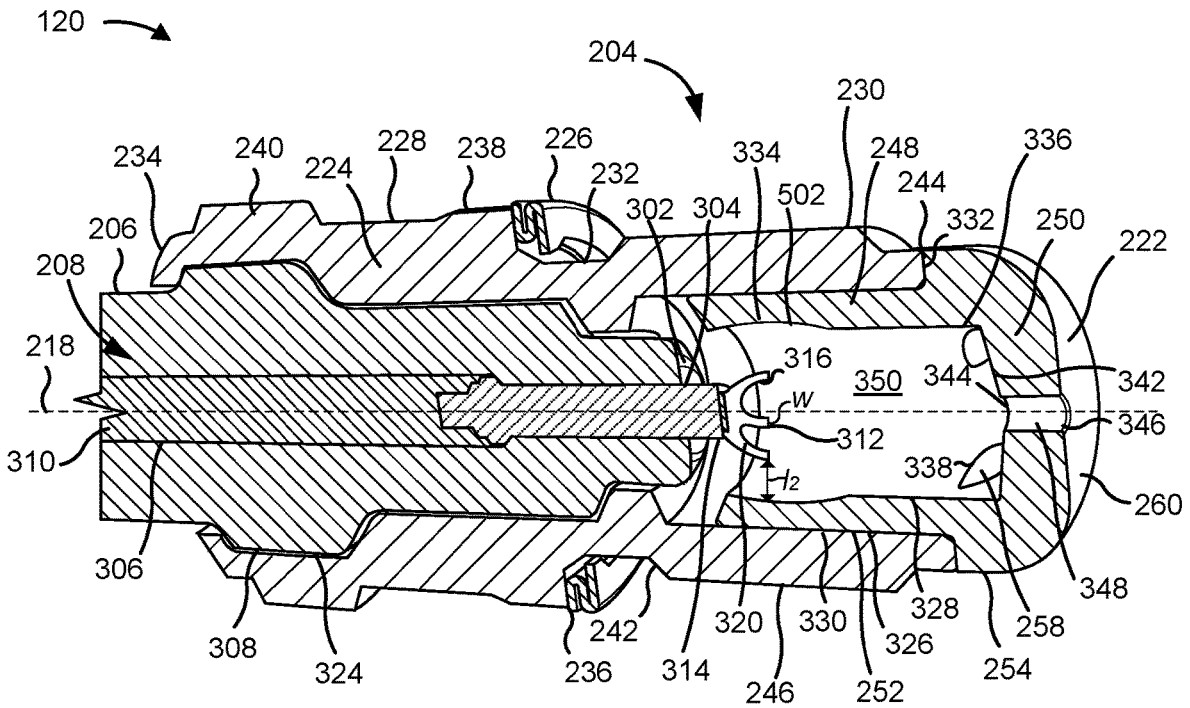
FIG. 5 is a cross-sectional view of the spark plug in a final state, taken along lines A-A of FIG. 2.
Figure 6:
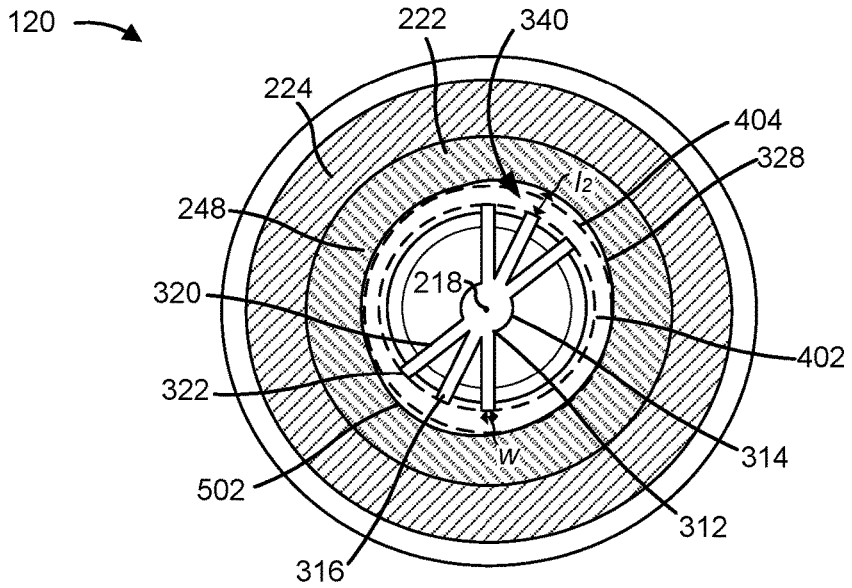
FIG. 6 is a cross-sectional view of the spark plug in the final state, taken along lines B-B of FIG. 2.

FIGS. 2-6 depict the spark plug 120. As will be explained below, FIGS. 3-6 depict internal components of the spark plug 120 in different states of wear. In particular, FIGS. 3-4 depict the internal components of the spark plug 120 in an initial (e.g., unworn) state. FIGS. 5-6 depict the internal components of the spark plug 120 in a final (e.g., substantially worn) state.

The spark plug 120 includes a body 202 and a nozzle assembly 204 secured thereto. The body 202 includes an insulator 206 and a central conductor 208. The insulator 206, which may be made of ceramic or another type of electrically-insulating material, is configured to electrically isolate the central conductor 208 and maintain structural integrity of the spark plug 120 in a high temperature environment. The insulator 206 includes an upper end surface 210, a lower end surface 302, and an exterior surface 212 that connects the upper end surface 210 to the lower end surface 302. The upper end surface 210 includes an upper opening 214, and the lower end surface 302 includes a lower opening 304 that communicates with the upper opening 214 to define a through hole 306. The exterior surface 212, which may be substantially cylindrical in shape, includes a plurality of annular ribs 216 and a flange 308. The plurality of annular ribs 216 are arranged at a location proximate to the upper end surface 210 and are configured to mitigate grounding of the electric current traveling through the spark plug 120. The flange 308, which is arranged at a location proximate to the lower end surface 302, is shaped and sized to facilitate attachment of the insulator 206 to the nozzle assembly 204.

The central conductor 208 is a series of electrical conductors which are sequentially arranged along a longitudinal axis 218 of the spark plug 120 and are together electrically connected to transmit the electric current from the electric energy source 112 into the nozzle assembly 204. The series of electric conductors include a terminal connector 220, a terminal pin 310, and a central electrode member 312. The terminal connector 220 is a conductive component that is mounted to the upper end surface 210 of the insulator 206 and is configured to be connected to a wire extending from the electrical energy source 112. The terminal connector 220 may be, for example, made of a nickel alloy. The terminal pin 310 is an elongated conductive element that is received in and extends along the through hole 306 of the insulator 206 to connect the terminal connector 220 to the central electrode member 312. The terminal pin 310 may be, for example, made of steel.

The central electrode member 312 is a conductive component that is sized and arranged to interact with an outer electrode member 222 (described below) to generate an electric arc or spark within the nozzle assembly 204 to cause the air-fuel mixture to combust within the cylinder 124. The central electrode member 312, which may be made of a material such as an iridium alloy or a platinum alloy, includes a central base 314 and a plurality of electrode prongs 316 extending therefrom. The central base 314 is secured within the through hole 306 and protrudes from the lower opening 301 of the insulator 206. As shown in FIG. 4, the central base 314 is substantially centered on the longitudinal axis 218, which extends through a geometric center of a first reference circle 402. The plurality of electrode prongs 316, which may be substantially identical to one another, may include six electrode prongs, five electrode prongs, four electrode prongs, or another quantity of electrode prongs. Other arrangements of the plurality of electrode prongs 316 are contemplated. For example, the plurality of electrode prongs 316 may form an equiangular arrangement.

Each of the plurality of electrode prongs 316 (hereinafter referred to as the electrode prong 316) includes an axial portion 318 and a radial portion 320 that connects the axial portion 318 to the central base 314. The axial portion 318 extends in an axial direction and includes an outer surface 322 that defines a width w of the electrode prong 316 and partially defines the first reference circle 402. In other words, the outer surfaces 322 of the axial portions 318 lie on the first reference circle 402. The axial direction is substantially parallel to the longitudinal axis 218. The radial portion 320 extends in a radial direction that is substantially perpendicular to the longitudinal axis 218. In some implementations, at least a portion of the radial portion 320 may be curved and thus extend at an acute angle relative to the radial direction. As will be described below, the electrode prong 316 is sized and positioned, relative to the nozzle assembly 204, in such a way that extends a service life of the spark plug 120. For reference, the electrode prong 316 further includes a thickness t that is substantially perpendicular to the width w.

The nozzle assembly 204 includes a housing 224, a gasket 226, and an outer electrode member 222. The housing 224, which may be made of carbon steel, is configured to be secured to the exterior surface 212 of the insulator 206. The housing 224 includes a first protruding segment 228, a second protruding segment 230, and a connection segment 232 therebetween. The first protruding segment 228 includes a first upper surface 234, a first lower surface 236, a first outer surface 238, and a first inner surface 330. The first upper surface 234 is opposite to the first lower surface 236. The first outer surface 238, which is opposite to the first inner surface 324, includes an engagement portion 240 that is configured to be engaged by a tool or otherwise engaged to facilitate attachment of the spark plug 120 to the cylinder head 126. For example, the engagement portion 240 may include a hex protrusion that is configured to be rotated by a wrench. The first inner surface 324 is configured to be secured to the flange 308 of the insulator 206.

The second protruding segment 230 includes a second upper surface 242, a second lower surface 244, a second outer surface 246, and a second inner surface 326. The second upper surface 242 faces the first lower surface 236 and is opposite to the second lower surface 244. The second outer surface 246 includes external threads to facilitate threadably attaching the spark plug 120 to the bore 128 within the cylinder head 126 to position the outer electrode member 222 within the cylinder 124. The connection segment 232 is sized to improve sealing of the bore 128. For example, the connection segment 232 may have a relatively increased length in a range of approximately 5 millimeters (mm) to approximately 6 mm.

The gasket 226 is an annular sealing component that is configured to be secured to the first lower surface 236 of the housing 224 to seal the bore 128 of the cylinder head 126. To resist creep, the gasket 226 may be made of INCONEL® or a similar type of material. In other words, the gasket 226 may be configured to mitigate the potential of deformation due to exposure to mechanical stresses associated with the combustion process.

The outer electrode member 222 is a conductive component that is configured to interact with the central electrode member 312 to generate the electric arc therebetween. When attached to the housing 224 of the spark plug 120, as described below, the outer electrode member 222 is concentric with and surrounds the central electrode member 312. The outer electrode member 222, which may be made of a nickel alloy, a platinum alloy, or an iridium alloy, includes a side wall 248 and a bottom wall 250. The side wall 248 includes an exterior surface 252 and an interior surface 328 that is opposite to the exterior surface 252. The exterior surface 252 includes a first exterior axial portion 330, a second exterior axial portion 254, and a radial portion 332 extending therebetween. The first exterior axial portion 330 is configured to be attached (e.g., via welding, soldering, and/or the like) to the second inner surface 326 of the housing 224. The second exterior axial portion 254, which has a diameter that is substantially equal to a diameter of the second outer surface 246 of the housing 224, includes a plurality of exterior openings 256. The radial portion 332 is configured to be attached (e.g., via welding, soldering, and/or the like) to the second lower surface 244 of the housing 224.

The interior surface 328 of the outer electrode member 222 is configured to be radially spaced from the outer surfaces 322 of the axial portions 318 of the plurality of electrode prongs 316. The interior surface 328 includes a first interior axial portion 334 and a second interior axial portion 336, which may be substantially cylindrical in the initial state of the spark plug 120. The first interior axial portion 334 is opposite to the first exterior axial portion 330 of the side wall 248. The second interior axial portion 336, which is opposite to the second exterior axial portion 332 and of side wall 248, includes a plurality of interior openings 338 that fluidly communicate with the plurality of exterior openings 256 to define a respective plurality of side wall flow passages 258.

When the spark plus 120 is in the initial state, the interior surface 328 of the outer electrode member 222 defines a second reference circle 404. In other words, when the spark plug 120 is unworn, both the first interior axial portion 334 and the second interior axial portion 336 lie on the second reference circle 404. The second reference circle 404 has a diameter that is greater than a diameter of the first reference circle 402 by an initial length h of a gap 340, across which the electric current extends to form the electric arc.

The bottom wall 250 of the includes an upper surface 342, which has an upper opening 344, and a lower surface 260, which has a lower opening 346. The lower opening 346 fluidly communicates with the upper opening 344 to define a bottom wall flow passage 348. Together with the plurality of side wall flow passages 258, the bottom wall flow passage 348 is configured to permit the air-fuel mixture to flow into a pre-combustion chamber 350 formed by a combination of the insulator 206, the housing 224, and the outer electrode member 222.

As implemented within the power system 100, the spark plug 120 has a limited service life due to erosion of the central electrode member 312 and the outer electrode member 222. Based on activating the power system 100, the air-fuel mixture may flow into the pre-combustion chamber 350 through the plurality of side wall flow passages 258 and the bottom wall flow passage 348 as the piston 118 travels upward toward the TDC position to compress the air-fuel mixture. The electrical energy source 112 transmits a pulse of electric current, which travels along the central conductor 208 and enters the pre-combustion chamber 350 as the piston 118 approaches a desired position. Because the voltage of the electric current exceeds a dielectric strength of the air-fuel mixture, the electric current bridges the gap 340 between the central electrode member 312 and the outer electrode member 222. With the air-fuel mixture ionized by the electric current, temperature and pressure in the pre-combustion chamber 350 increases rapidly to generate a spark, leading to combustion within the cylinder 124. As the engine 108 continues to operate, the spark plug 120 will continue to generate sparks between the central electrode member 312 and the outer electrode member 222, which exposes the central electrode member 312 and the outer electrode member 222 to the extreme temperature and pressure. Due to such exposure, the plurality of electrode prongs 316 of the central electrode member 312 experience particle ejection and surface oxidation, which causes the plurality of electrode prongs 316 to gradually shorten along the longitudinal axis 218 until reaching the final state shown in FIGS. 5-6. At the same time, the first interior axial portion 334 of the interior surface 328 likewise experiences particle ejection and surface oxidation, which causes a concavity 502 to develop in the interior axial portion 334 and thus increases a length of the gap 340. As the plurality of electrode prongs 316 shorten, the concavity 502 correspondingly elongates along the longitudinal axis 218 until likewise reaching the final state. When the spark plug 120 is in the final state, which marks an end of the service life of the spark plug 120, the pulses of electric current are no longer able to bridge the gap 340, which has increased in size from the initial length $l_1$ (shown in FIGS. 3-4) to a final length $l_2$ (as shown in FIGS. 5-6). In the final state, the plurality of electrode prongs 316 may have a reduced length that is less than an initial length of the plurality of electrode prongs 316 by at least 1.5 mm.

In order to function as described above, the central electrode member 312 and the outer electrode member 222 are sized and positioned relative to one another such that a rate of shortening of the plurality of electrode prongs 316 is substantially equal to a rate of elongation of the concavity 502. In other words, based on the series of electric arcs extending through the air-fuel mixture within the pre-combustion chamber 350, the central electrode member 312 and the outer electrode member 222 are configured to wear at a substantially uniform rate along the longitudinal axis 218. To achieve this substantially uniform rate of wear, the central electrode member 312 and the outer electrode member 222 are sized and arranged such that there is an inverse relationship between the width w of the electrode prong 316 and the initial length $l_1$ of the gap 340. In some implementations, such a relationship may be represented by $$P = \frac{w^2\sqrt{l_1}}{t^{2.5}}$$

where P is a parameter having a value in a range of approximately 1.5 to approximately 7.5, w is the width of an electrode prong 316 in mm, $l_1$ is the initial length of the gap 340 in mm, and t is the thickness of the electrode prong 316 in mm. In some implementations, the value of the parameter P may be in a range of approximately 2.25 to approximately 2.75. In some implementations, the value of the parameter P may be in a range of approximately 4.5 to approximately 5.5. Other values are herein contemplated.

As indicated above, FIGS. 2-6 are provided as an example. Other examples may differ from what is described with regard to FIGS. 2-6. For example, the number and arrangement of components may differ from that shown in FIGS. 2-6. Thus, there may be additional components, fewer components, different components, differently shaped components, differently sized components, and/or differently arranged components than those shown in FIGS. 2-6. For example, the outer electrode member 222 may include a different arrangement and/or quantity of flow passages (e.g., one flow passage, two flow passages, or another quantity).

INDUSTRIAL APPLICABILITY

The spark plug 120 of the present disclosure is particularly applicable within the engine 108 of the power system 100. The engine 108 may be configured to utilize fuel (e.g., CNG, methanol, ethanol, bioethanol, gasoline, and/or the like) to power a generator, propel a movable machine (e.g., a motor vehicle, a railed vehicle, a watercraft, an aircraft), and/or the like.

In contrast to spark plugs of the prior art, in which electrodes tend to wear unevenly and thus waste material that might otherwise have been utilized to generate additional sparks, the spark plug 120 of the present disclosure is configured such that the central electrode member 312 wears along the longitudinal axis 218 at a rate that is substantially equal to that of the outer electrode member 222. As a result, the spark plug 120 has an extended service life compared to spark plugs of the prior art, with the central electrode member 312 being configured to shorten by at least 1.5 mm along the longitudinal axis 218 from an initial length to a reduced length. Furthermore, due to the narrower and/or thinner design of the plurality of electrode prongs 316, more space is available within the pre-combustion chamber 350. As a result, the central electrode member 312 may include additional electrode prongs 316 which are thus capable of further extending the service life of the spark plug 120. Because the spark plug 120 has an increased service life relative to other spark plugs, the spark plug 120, when utilized within the power system 100, may conserve material and expenses that would otherwise result from repair and/or replacement of the spark plug 120.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, as used herein, the terms "comprises," "comprising," "having," "including," or other variations thereof, are intended to cover non-exclusion, such that a process, method, article, or apparatus that comprises a list of elements does not include only those elements, but may include other elements not expressly listed. In addition, in this disclosure, relative terms, such as, for example, "about," "generally," "substantially," and "approximately" are used to indicate a possible variation of ±10% of the stated value, except where otherwise apparent to one of ordinary skill in the art from the context. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A spark plug, comprising:

a central electrode member that includes a base and a plurality of electrode prongs extending from the base, wherein the base is substantially centered on a longitudinal axis that extends through a geometric center of a first reference circle and a second reference circle, wherein the first reference circle has a first diameter, the second reference circle has a second diameter that is greater than the first diameter, and a gap length is based on the first diameter and the second diameter, and an electrode prong, of the plurality of electrode prongs, includes an axial portion and a radial portion, wherein the axial portion includes an outer surface that partially defines the first reference circle, wherein the axial portion extends in an axial direction that is substantially parallel to the longitudinal axis, and the axial portion has a width along a circumferential direction of the first reference circle and a thickness along a radial direction that is perpendicular to the axial direction, and the radial portion connects the axial portion to the base; and an outer electrode member that includes an interior surface that defines the second reference circle; and wherein $$P = \frac{w^2\sqrt{l}}{t^{2.5}}$$

where P is a parameter having a value in a range of approximately 1.5 to approximately 7.5, w is the width in millimeters, 1 is the gap length in millimeters, and t is the thickness in millimeters.

2. The spark plug of claim 1, wherein the plurality of electrode prongs includes six electrode prongs.

3. The spark plug of claim 1, wherein the central electrode member is made of one of an iridium alloy or a platinum alloy, and the outer electrode member is made of one of a nickel alloy, an iridium alloy, or a platinum alloy.

4. The spark plug of claim 1, wherein the outer electrode member includes a side wall and a bottom wall;

the side wall includes the interior surface;

the bottom wall includes an upper surface; and the interior surface and the upper surface together form part of a pre-combustion chamber.

5. The spark plug of claim 4, wherein the side wall further includes:

an exterior surface that is opposite the interior surface; and at least one flow passage that is configured to permit an air-fuel mixture to flow into the pre-combustion chamber.

6. The spark plug of claim 5, wherein the central electrode member and the outer electrode member are configured to wear at a substantially uniform rate along the longitudinal axis based on a series of electric arcs extending through the air-fuel mixture within the pre-combustion chamber.

7. A spark plug comprising:

a central electrode member that includes:

a central base substantially centered on a longitudinal axis, and at least four electrode prongs extending radially and axially from the central base; and an outer electrode member that is concentric with and surrounds the central electrode member, wherein the outer electrode member includes a wall that is radially spaced from the at least four electrode prongs and extends circumferentially and continuously around the longitudinal axis, to allow a series of electric arcs to form between the wall and the at least four electrode prongs, and the wall is located at a constant radial distance from the longitudinal axis;

wherein the outer electrode member and the central electrode member are sized and positioned relative to one another such that a first rate of wear of the outer electrode member, along the longitudinal axis, is substantially equal to a second rate of wear of the central electrode member along the longitudinal axis.

8. The spark plug of claim 7, wherein $$P = \frac{w^2\sqrt{l}}{t^{2.5}}$$

where P is a parameter having a value in a range of approximately 1.5 to approximately 7.5, w is a width in millimeters of each of the at least four electrode prongs, 1 is a length in millimeters of a gap between each of the at least four electrode prongs and the wall of the outer electrode member, and t is a thickness in millimeters of each of the at least four electrode prongs.

9. The spark plug of claim 8, wherein the value of P is in a range of approximately 2.25 to approximately 2.75.

10. The spark plug of claim 8, wherein the value of P is in a range of approximately 4.5 to approximately 5.5.

11. The spark plug of claim 7, wherein each of the at least four electrode prongs includes:

a radial portion that extends in a direction that is substantially perpendicular to the longitudinal axis; and an axial portion that extends in a direction that is substantially parallel to the longitudinal axis.

12. The spark plug of claim 11, wherein the axial portion includes an outer surface that faces an interior surface of the wall, and a distance between the outer surface and the interior surface defines a gap.

13. The spark plug of claim 7, wherein the wall of the outer electrode member is a side wall, and the outer electrode member further includes a bottom wall that together with the side wall forms part of a pre-combustion chamber.

14. The spark plug of claim 13, wherein the side wall of the spark plug includes a plurality of flow passages that are configured to permit an air-fuel mixture to flow into the pre-combustion chamber and repeatedly combust based on the series of electric arcs.

* * * * *